US005632315A

United States Patent [19]

Rose

[11] Patent Number: 5,632,315

[45] Date of Patent: May 27, 1997

[54] LIQUID DISPENSERS

[76] Inventor: Howard Rose, 73 Fluin Lane, Frodsham, Cheshire WA6 7QT, England

[21] Appl. No.: 352,427

[22] Filed: Dec. 8, 1994

Related U.S. Application Data

[63] Continuation of Ser. No. 871,974, Apr. 22, 1992, abandoned, which is a continuation-in-part of Ser. No. 836,654, Feb. 18, 1992, abandoned.

[30] Foreign Application Priority Data

Apr. 23, 1991 [GB] United Kingdom ..... 9108655

[51] Int. Cl.[6] ..... B65B 1/04

[52] U.S. Cl. ..... 141/329; 141/363; 141/364

[58] Field of Search ..... 141/329, 27, 89, 141/320, 312, 363, 364, 365, 375, 382, 83, 18; 604/463, 415, 408, 410, 411, 412, 414, 416, 905, 240, 243, 283; 128/91.2

[56] References Cited

U.S. PATENT DOCUMENTS

| | | | |
|---|---|---|---|
| 4,592,092 | 5/1986 | McPhee | 383/80 |
| 4,834,152 | 5/1989 | Howson et al. | 141/286 |
| 4,836,397 | 6/1989 | Fowles | 220/214 |
| 5,108,387 | 4/1992 | Falk et al. | 604/408 |
| 5,137,527 | 8/1992 | Miller et al. | 604/415 |

FOREIGN PATENT DOCUMENTS

| | | |
|---|---|---|
| 327519 | 8/1989 | European Pat. Off. . |

*Primary Examiner*—David J. Walczak

[57] ABSTRACT

The present invention provides a container, especially a resealable liquid dispensing container, for dispensing sterile liquids, the container comprising a reservoir and a dispensing neck, the neck being hermetically sealed, a cap being locatable over the neck and comprising a piercing member, the piercing member being so configured as to pierce the seal on the neck when the cap is forcibly fitted thereover, and sealingly engage a collar beneath the seal within the container, thereby reducing the possibility of leaks.

20 Claims, 4 Drawing Sheets

LIQUID DISPENSERS

This is a continuation of application Ser. No. 07/871,974 filed on Apr. 22, 1992, now abandoned, and which is a continuation of application Ser. No. 07/836,654, filed Feb. 18, 1992, now abandoned.

FIELD OF THE INVENTION

The present invention relates to a container, especially a resealable liquid dispensing container, for dispensing sterile liquids, the container comprising a reservoir and a dispensing neck, the neck being hermetically sealed, a cap being locatable over the neck and comprising a piercing member, the piercing member being so configured as to pierce the seal on the neck when the cap is forcibly fitted thereover.

BACKGROUND OF THE INVENTION

It is frequently desired to provide receptacles, such as bottles and ampoules, which contain sterile liquids, and which can be re-used. Unit dose containers can be provided, but these can be relatively expensive to produce in large numbers, and also bulky and inconvenient to use, especially when multiple doses are required.

It is known in the art to provide bottles containing sterile liquids, a rubber septum covering the neck of the bottle. To extract the desired amount of liquid, a needle is inserted into the container, and liquid extracted through the needle. When the desired amount of liquid has been removed, the needle is withdrawn, and the rubber reseals the small hole that is left.

Multi-use containers are generally made of glass, while single dose containers are typically made of a flexible plastics material which collapses on extraction of the liquid, rather than causing air to be sucked back in, or leaving a vacuum. The neck of such receptacles needs to be relatively solid, to prevent the collapse of this part of the receptacle.

In either case, the result is that the rubber septum needs to be made of a different material from the bottle, and must be positioned during manufacture, requiring expensive and complicated apparatus.

Alternatives have been sought, and one such alternative involves a blow-fill-seal bottle or ampoule, wherein a cap can fit over the neck. The cap is fitted with a piercing device, so that when the cap is forcibly positioned over the neck of the ampoule, the ampoule is pierced.

The problem with the above construction is that blow-fill-seal ampoules are necessarily made using two substantially similar moulds, thereby leaving a seam around the bottle or ampoule which will be centrally placed on the neck. The piercing point is placed in the centre of the cap for effectiveness and, so, will have to pierce the seam which could then split, for example. However, the most undesirable aspect of this construct is that the seam extends all of the way around the ampoule, so that not only does the piercing point have to pierce the seam, but the cap also has to fit over the seam in at least two places. The problem is that, in blow-fill-seal constructions, the seam tends to stand proud of the ampoule, so that leakage from the cap at the seams of the bottle is difficult or impossible to prevent.

The problem has been addressed, and a further construct is known which effectively reduces the possibility of leakage by duplicating the mating arrangement of the cap with the ampoule. Thus, at the top of the neck of the ampoule, there is a nipple. The cap is so designed that an inner cap fits tightly over the nipple, while the outer cap screws down over the neck. Within the inner cap is the piercing portion. Any leakage is thereby substantially limited to within the inner cap, although leakage is still observed into the outer cap, and occasionally beyond.

SUMMARY OF THE INVENTION

It is an object of the invention to provide a resealable container and cap arrangement that is not susceptible to leakage.

It is a further object of the invention to provide a resealable container and cap arrangement which is easy to manufacture, and does not require expensive technology.

It is a further object of the invention to provide a resealable container and cap arrangement which is susceptible to little or no leakage, and which can be manufactured by blow-fill-seal technology.

The present invention provides a container for dispensing sterile liquids, the container comprising a reservoir and a dispensing neck, the neck being hermetically sealed, a cap being locatable over the neck and comprising a piercing member, the piercing member being so configured as to pierce the seal on the neck when the cap is forcibly fitted thereover, characterized in that, when the cap is forcibly fitted over the seal on the neck, the piercing member locates in and sealingly engages a collar beneath the seal within the container.

DETAILED DESCRIPTION OF THE INVENTION

Figure 1:
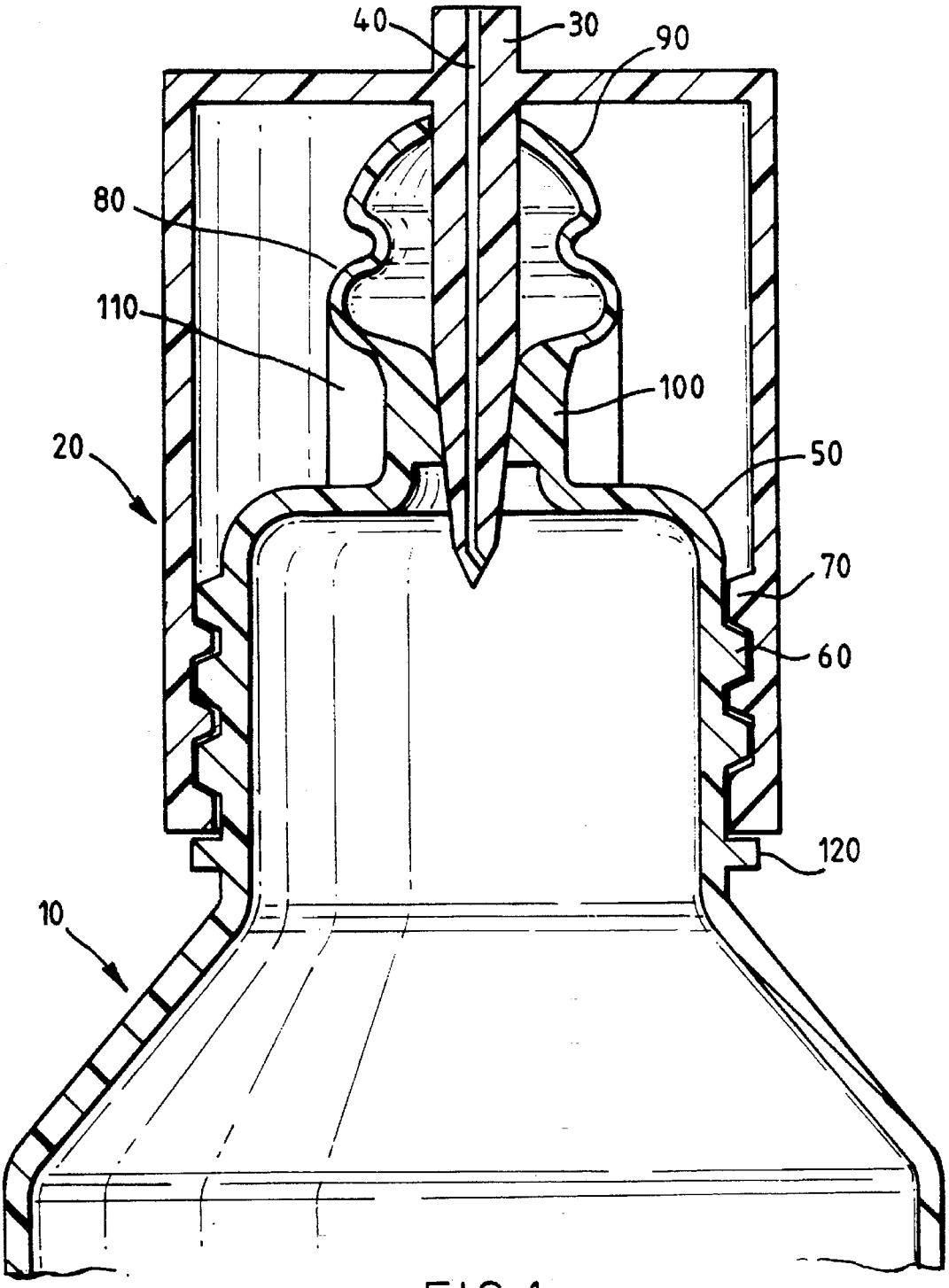
FIG. 1 represents a bottle and cap in accordance with the present invention.

Thus, although a seam may be formed around the container, thereby making it difficult to render the cap water-tight, the primary seal is that which is formed between the piercing member and the inner collar. Accordingly, if the main purpose of the cap is to provide a dispensing means, then the cap may serve only the purpose of a guide for the piercing member. However, the cap may serve essentially as a seal, with removal of the cap being necessary to allow the dispensing of liquid, in which case the invention effectively provides a simple but highly efficient stopper for the ampoule or bottle.

The present invention is not restricted to blow-fill-seal technology but, as this is generally the most appropriate, the invention will usually be described by reference to blow-fill-seal technology, without being limited thereby.

The collar beneath the seal is also referred to herein as an inner collar.

There is no particular restriction on the type of container, provided that it is capable of containing liquids and carrying a sufficiently firm neck.

The neck may be reinforced, if desired. Such reinforcement may take the form of thickened walls, or may take the form of supporting webs extending from the body of the container along the neck and to the mouth, for example. Other suitable forms of reinforcement will be apparent to those skilled in the art.

Preferably, the reservoir will be collapsible to prevent suck-back, although the use to which the contents are put will largely determine the type of container required, as will readily be apparent to one skilled in the art. Suitable containers may also include those made of glass or rigid plastics, where appropriate.

It will be appreciated that the type of container may be adapted for either single or multi-use/resealable embodiments.

For the purposes of the present invention, it is particularly preferred that the container be a blow-fill-seal container having a thicker, stronger neck, and thinner collapsible walls. The material concerned may be any suitable polymer, such as polyethylene, polypropylene or polybutylene, preferably polyethylene.

The neck of the container should be sufficiently rigid that a cap can be screwed on to it, or forced over it, without the neck collapsing in use. It is particularly preferred that the neck should be equipped with a screw-thread so that the force required to locate the cap over the neck can be applied by simple torque, rather by than by brute force. Excess force can be dangerous where pointed objects are used, such as with certain embodiments of the piercing member, or if the container of the invention is glass.

The force required to locate the cap may be minimal, in which case a mere push-fit can suffice. Such an arrangement may occasionally be adequate where the seal is ruptured by the piercing member before the cap engages the neck. However, if fitting the cap on the neck is a necessary adjunct to rupture of the seal, then the seal might tend to be too weak to withstand anything other than the most careful handling, if the cap were adapted only for a push-fit. A screw-thread, for example, may then be more appropriate.

Nevertheless, push-fit applications are within the scope of the present invention, and may be preferred in certain circumstances. In addition, it may be desirable to provide a bayonet fitting, wherein there is provided at least one, and preferably two, slots either on the neck or in the cap, which marry with corresponding ridges in the cap or on the neck.

The present invention also envisages embodiments ranging between bayonet fittings and screw threads, such as a half thread which is at a steep angle, such that less than the whole circumference of the neck is described before termination of the thread. It will be appreciated that, whatever the type of thread, including screw threads, bayonet fittings and half threads, the number of threads is at least one, and will usually be in the region of two or three, especially where a thread does not describe the entire circumference of the neck/cap.

Whatever the type of fit employed, it may also be desirable to provide an outer, snap-fit collar. In such an embodiment, a groove, generally around the neck, but alternatively within the cap, marries with a ridge within the cap or around the neck, as appropriate, such that, when the cap is fitted over the neck, it is locked into place. Such a groove, when on the cap, may be formed by a suitable flange or flanges. In any case, wherever the groove is located, certain embodiments may employ a discontinuous groove and/or a discontinuous ridge, as appropriate.

The seal over the neck usefully will be formed during the blow-fill-seal operation by the action of the head-mould. This is well-known blow-fill-seal technology. As such, it is likely that a seam will be formed on the seal. However, if desired, the seam in the area where puncture is to take place can be diverted from the puncture site by appropriate moulding technology. For example, a suitable blade, or tongue and groove arrangement, may be used in the head mould to divert the seam at the relevant point.

Further, after moulding, but before the bottle has entirely cooled, a pointed implement may be used to create a dimple in the seal to guide the piercing member. Such an embodiment is particularly appropriate where a push-fit cap is used. Other suitable modifications may also be made in accordance with techniques well-known in the art.

The collar into which the piercing member fits may, for example, be formed during, or immediately after, formation of the body, but before use of the head-mould, in a blow-fill-seal operation.

There is no particular limitation on the way that the collar may be formed, but it is preferred that the collar is integral with the body. Alternatively, a collar can be inserted into the neck of the bottle, and sealed thereto by heat-sealing, for example. The same effect may also be achieved by the use of an adhesive.

One suitable embodiment of the collar involves the use of a greater amount of plastics material in the neck. In a typical blow-fill-seal bottle or ampoule, this will tend to give a white, opaque appearance to the neck. A moulding tool may then be used before the neck has set to create the desired collar.

In general, it is preferred that the collar is formed after formation of the body by insertion of a suitable tool in the neck to create the desired necking.

The collar may comprise a simple, circular aperture into which the piercing member can be rammed until it proceeds no further, or may be in the nature of a female cone, such as a luer, into which the male luer of the piercing member fits. Regardless of the form of the collar, it will be appreciated that the opening must allow the passage of liquids. Such passage may, if desired, only be created after puncture. In one embodiment, therefore, a further seal is associated with the collar, generally either above or below, to prevent the passage of liquids, and which is adapted to be broken by the piercing member.

The piercing member is preferably in the form of an enclosed duct or needle, such that, after piercing the seal and engaging the collar, the liquid from the reservoir is able to flow through the piercing member, under force if necessary, to be dispensed beyond the cap as required. The duct may be straight, if desired, but this may lead to coring (and also see below). However, a straight duct may be preferred in a situation where it is desired to extend a hypodermic needle, for example, through the duct to extract the liquid.

In the alternative, the piercing member contains no duct for liquid dispensing, and the liquid can only be dispensed through the collar and the neck when the cap, together with piercing member, is removed sufficiently. In such an instance, removal need not necessarily be complete, and need only be sufficient to allow flow of the liquid about the piercing member into the cap which may, for example, have a separate aperture for releasing liquid, said aperture being optionally closable if desired.

The piercing member, when it contains a duct, preferably is not in the form of a hypodermic needle, for at least three reasons. One reason is that it is unlikely that a suitable collar can be so precisely configured that it will dock tightly with a hypodermic needle, at least in an economic embodiment. It is also unlikely that the needle would pass through the opening in the neck on every occasion, which would thereby leave the aperture in the collar open, through which the sterile liquid could escape. Such an embodiment is not precluded from the invention, and may be desirable under certain circumstances, but may be further undesirable for the following reasons.

Another reason for not using the form of a hypodermic needle is that the duct in a hypodermic needle has its opening in the tip of the needle. In such an embodiment, it is possible that forcing the needle through the seal would core the seal, thereby blocking the duct, and preventing access to the liquid, or leaving a small portion of plastic in the liquid, which is particularly undesirable in an injection form.

A third reason for not using such an embodiment lies in the form of the needle, as hypodermic needles are currently regarded as health hazards, and can lead to needle-stick injuries, currently causing particular concern because of the threat of such diseases as AIDS and hepatitis.

Thus, the preferred embodiment for the piercing member is a male cone, preferably a luer, having a duct which has its opening at or about the tip of the cone, but not at the apex of the cone. It is further preferred that any angle in the length of the bore of the duct that results from the opening of the duct not being in the tip of the cone be as shallow as possible. This is primarily for production reasons, allowing the duct former to be extracted.

If desired, the tip of the piercing member may be equipped with a metal point, or such like, to assist in puncturing the seal. In general, this will not be necessary, as the seal is preferably a frangible membrane adapted to withstand everyday handling, but not localized pressure. The tip of the piercing member may then be blunt, which will assist in locating the member in the collar without being so sharp as to pierce the solid part of the collar. By 'blunt' is meant sufficiently sharp to penetrate the membrane, but little or no sharper.

The piercing member may be an integral part of the cap, or it may be formed separately. In the latter instance, it is preferable that the abutment between cap and piercing member be fluid-tight, although for most embodiments this is not a requirement.

The piercing member and cap may be glued or welded together, if desired, and/or the member may be held in place mechanically, such as by force-fitting, screwing, and/or by having a circumferential flange preventing further motion of the member within the cap.

The seal over the neck of the bottle may be formed away from the inner collar, such as where the collar is at the base of the neck, and the seal is formed by the head-mould in the blow-fill-seal operation. In such a case, the piercing member may protrude substantially beyond the opening of the cap, so that the tip of the piercing member may already be within the collar before the cap engages the neck of the container. Ideally, in such a case, the cap may then be firmly screwed on to tightly locate the piercing member within the collar. However, any suitable length of piercing member may be employed.

In any event, a particularly preferred embodiment is where the first half-turn of the cap onto the screw thread of the neck causes rupture of the seal by the screw member, further action tightly locating the piercing member in the collar.

It is an advantage of the invention that the collar can be formed without a seam, thereby preventing any leakage. It is also an advantage that the piercing member can be formed without a seam. The whole apparatus is easy and inexpensive to manufacture, and yet generally more efficient than anything known in the prior art.

Where the piercing member is only intended to provide a stopper, the proximal end need only be flush with the top of the cap, and is preferred from the practical point of view, especially where the piercing member is formed in a single, integral unit with the cap.

Where the piercing member forms a duct for the fluid in the container, the proximal end may be flush with the cap, provided that the duct extends through the cap, allowing liquid in the container to exit therethrough. The exit of such a duct may be a simple bore, allowing the insertion of a suitable needle, for example.

In general, however, where the piercing member comprises a duct, the proximal end will protrude a distance beyond the cap. As with the above embodiment, the exit may be suitably configured to receive a suitable needle or nozzle. The proximal end of the piercing member may extend for a distance before being shaped, or may be shaped immediately on protrusion from the cap.

A suitable shape is a female luer, such as would be adapted to dock with the male nozzle of a syringe without a needle attached. Several syringes could then be attached in succession to withdraw fluid, with a minimum of contamination. If any time were to elapse between uses, a cover could be provided to prevent entry of dust.

Thus, it will be appreciated that containers of the present invention may also be used where it is desired to reconstitute the contents of the container. In such an instance, it is generally necessary to inject water or some other suitable liquid into the container through a septum, and then withdraw the reconstituted substance by a syringe. This can be messy, and the resulting sharps from the disposed needles can be dangerous.

The above embodiment, involving a female receptor for the male nozzle of a syringe without a needle, may then be further adapted such that the same proximal end also provides a male receptor to dock with a suitable reservoir of reconstituting fluid.

Accordingly, in a further aspect of the present invention, there is provided a container as described, wherein the cap and piercing member are so configured as to be useable as a transfer adaptor for fluid communication between the container and a syringe, the proximal end of the piercing member comprising;

a) a female receptor to receive the male exit nozzle of a syringe; and b) a male receptor for the female opening of a reservoir whose contents are intended for transfer into the container.

Other suitable configurations of the proximal end of the piercing member will be apparent from U.S. Ser. No. 07/836,654, filed 18 Feb. 1992, to the present Assignee, incorporated herein by reference.

Typically, the male and female receptors on the piercing member are located such that the female receptor is effectively within the male receptor.

The reservoir having the female opening is suitably a blow-fill seal ampoule. The male receptor of the transfer adaptor is preferably so designed as to fit snugly into the female opening of the reservoir, particularly wherein the male receptor of the transfer adaptor is configured such that the contours of the male receptor exactly fit those of the female opening.

The male receptor may also be elongated so that the base of the receptor is broader than it is expected to encounter with a female opening of an ampoule, while the tip of the receptor may be narrower than it is expected to encounter with a female opening of an ampoule.

In general, it is preferred that, in this embodiment, the opening, receptors and nozzle are all essentially luer-shaped.

The female receptor of the transfer adaptor is preferably contoured to fit exactly with the syringe nozzle. An upwardly directed wall may be provided about the male and female receptors for protection. The upstanding wall may suitably be provided with a cover.

In use, the bottle, or ampoule, may be for one-off or multi-dose, usage. It may be arranged in a suitable manner to best facilitate withdrawal of the liquid, such as by being suspended. It may be suspended upside down to bring the liquid nearer the point of withdrawal, or may be suspended by the neck where the bottle is collapsible. If the ampoule or bottle is intended for one-off use and is flexible, then it may be provided inside a solid housing to avoid puncturing, or where the container is particularly mobile, which might make handling difficult. Other suitable modifications will be readily apparent to those skilled in the art.

Turning to the drawings, FIG. 1 shows a bottle 10, in association with a cap 20. Within the cap is located a needle 30, containing a bore, or duct, 40. The neck 50 of the bottle 10 is equipped with a screw thread 60 matching a screw thread 70 of the cap 20. Also located on the neck 50 is a head portion, generally indicated at 80, comprising a seal 90, a collar 100, and a supporting web 110, the neck being reinforced thereby.

In use, the needle 30 pierces the membrane 90, whereupon the cap 20 engages the neck 50 and the needle 30 enters the collar 100. Further screwing down of the cap 20 ensures a tight fit of the needle 30 in the collar 100. Accordingly, the only exit for the liquid carried by the bottle 10 is via the duct 40.

Other features of the arrangement of FIG. 1 include the angle of the opening of the duct 40, which is adapted to prevent coring on rupture of the membrane 90, and the end-stop 120, preventing over-screwing of the cap.

Figure 2:
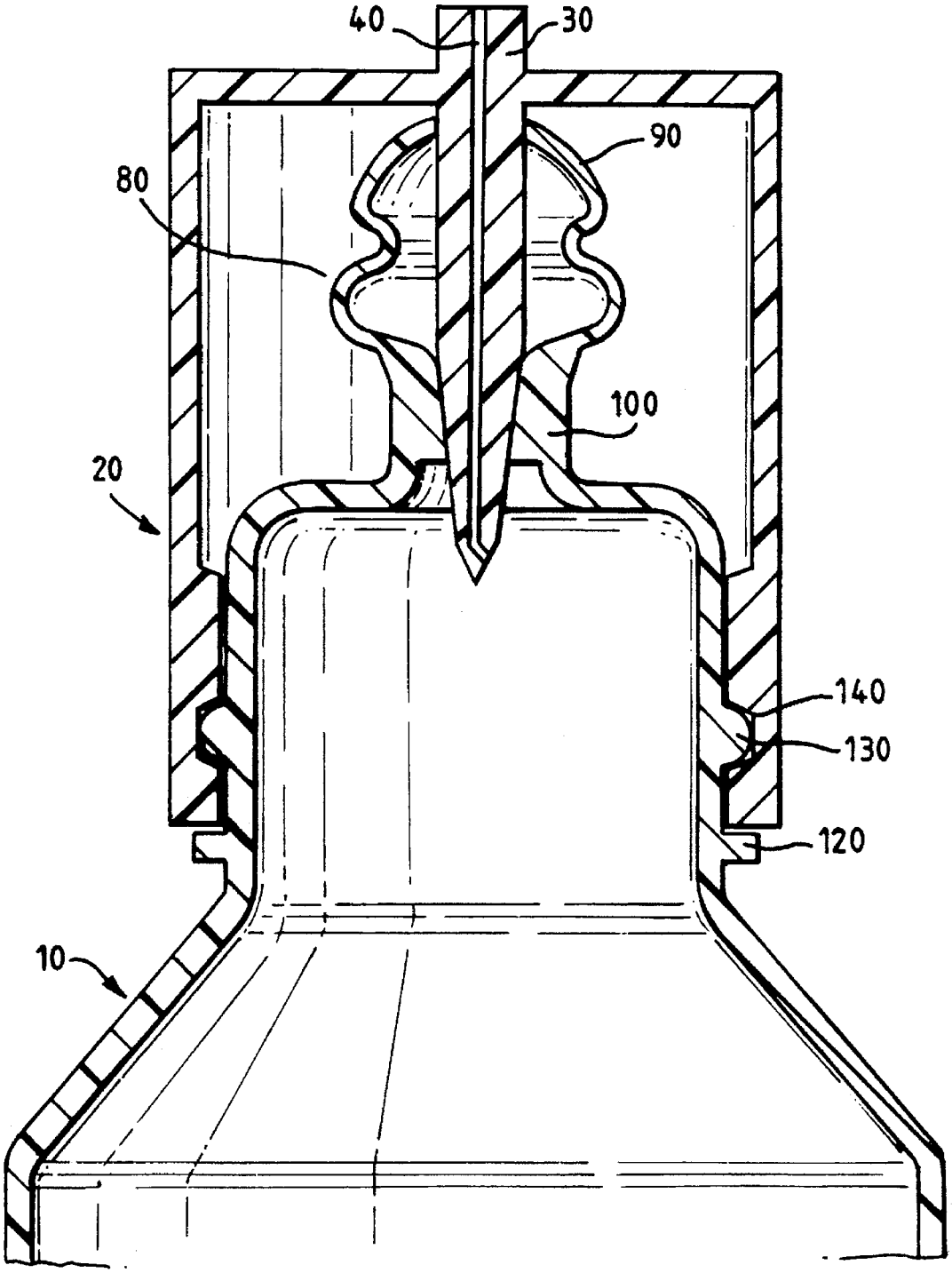
FIG. 2 represents an alternative bottle and cap in accordance with the present invention.

FIG. 2 shows an arrangement similar to that of FIG. 1, wherein there is no screw thread. In this embodiment, there is, instead, provided a snap-fit ring, generally located at 130, which engages a groove 140 in the cap 20. When the cap 20 is located over the neck 50, the ring and groove arrangement serves to lock the cap in place, thereby preventing the cap from moving or falling off in use.

In this embodiment, there is no web 110.

Figure 3:
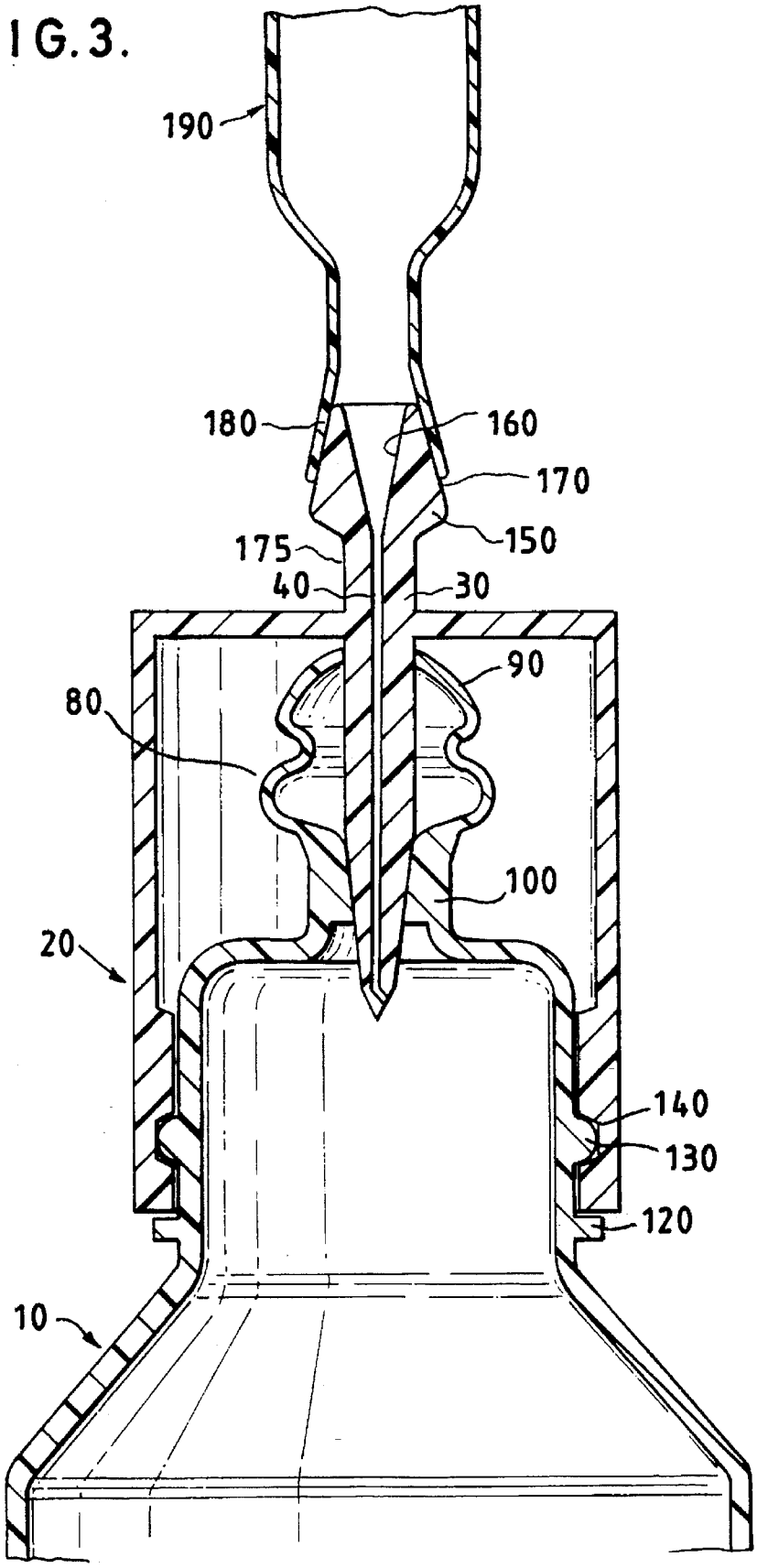
FIG. 3 represents a container of the invention wherein the distal end of the piercing member is mated with an ampoule.
Figure 4:
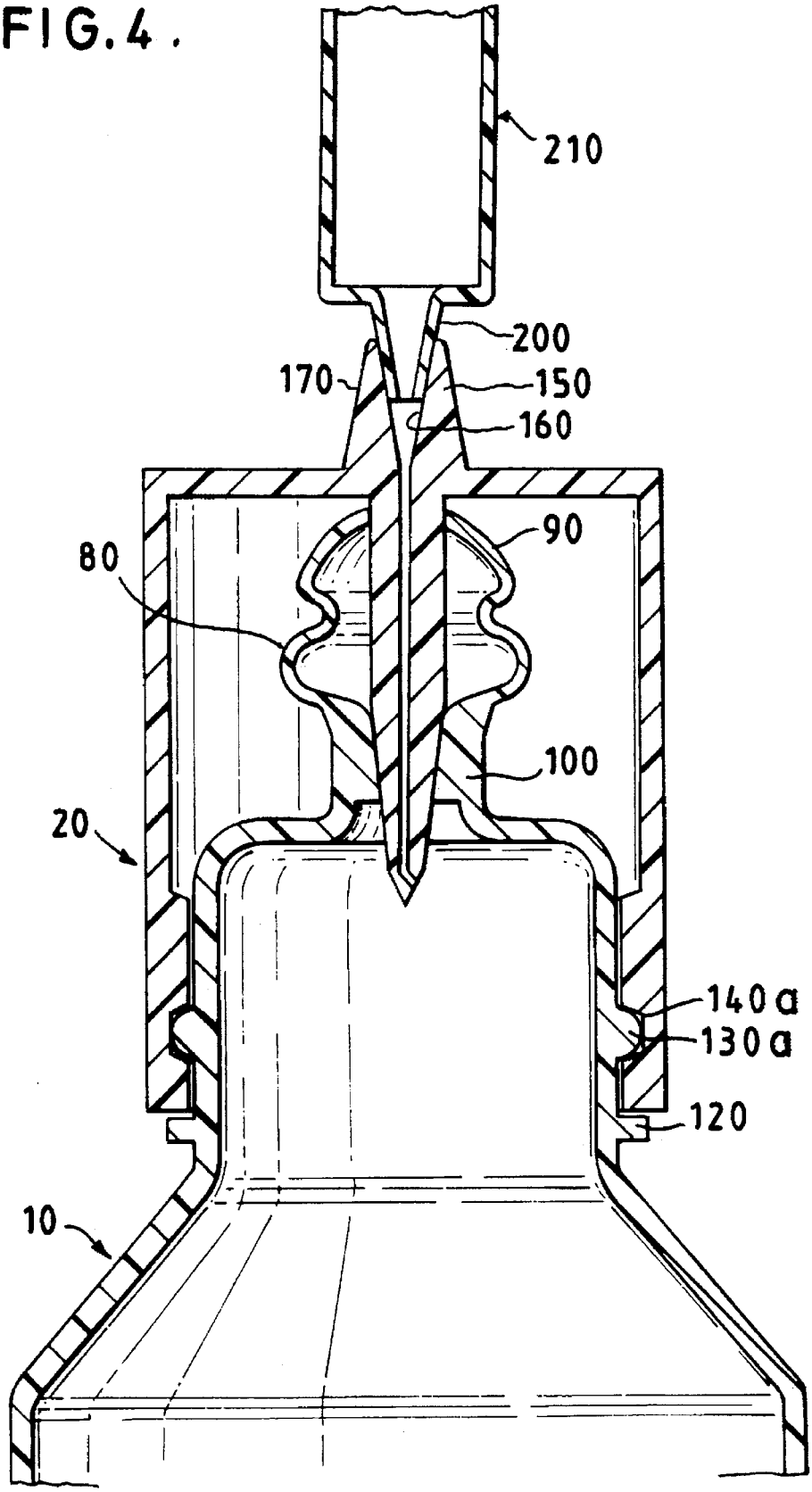
FIG. 4 represents a further embodiment of the invention wherein the cap is mated with the male exit nozzle of a syringe.

In FIGS. 3 and 4, the same numbering is used as before, but the proximal end 150 of the piercing member or needle 30 protrudes beyond the cap 20. In each case, there are provided female receptor 160 and male receptor 170. In FIG. 3, the male and female receptors 170, 160 are separated from the cap 20 by a short stem 175. The neck 180 of an ampoule 190 is shown mated with male receptor 170, thereby to permit transfer of liquid from the ampoule 190 into the bottle 10.

In FIG. 4, the male and female receptors 170, 160 are not separated from the cap 20 by a stem. The male nozzle 200 of a syringe 210 is shown mated with female receptor 160, thereby to permit withdrawal of liquid from the container 10. This will generally be effected with the container 10 in an inverted position. In addition, the cap 20 is shown associated with the bottle 10 by means of a bayonet fitting consisting of two or more nubs 130*a* circumferentially disposed about the neck 50 and adapted for slidable engagement within detente grooves 140*a*.

It will be appreciated that the dimensions shown in the accompanying Figures are not necessarily representative, and are given for illustrative purposes only.

Thus, the present invention has the advantage that a resealable container and cap arrangement can be provided which is susceptible to little or no leakage. The technology is easy to use, with no complex strategies or tight-fitting members being required to effect a fluid-tight seal. The invention is particularly appropriate to blow-fill-seal technology, the provision of a collar beneath the seal merely requiring suitable modification of a standard-type mould, for example.

It will be appreciated that many variations and modifications may be made to the containers and caps of the invention, and that the present invention should be construed in accordance with the accompanying claims.

What is claimed is:

1. A container for dispensing sterile liquids, said container comprising a reservoir, a dispensing neck having a hermetic seal and a collar, wherein said reservoir, neck, seal and collar are formed together as a one piece unit, said collar having an aperture and being located within said container and in juxtaposition to said seal, a cap for said container being locatable over said neck and comprising a piercing member, wherein said cap and said piercing member are so configured that, when said cap is forcibly fitted over said neck, said piercing member passes into said neck;

pierces said seal; and locates in and sealingly engages the aperture in said collar.

2. The container of claim 1, wherein said container is a blow-fill-seal container having a thicker, stronger neck, and thinner collapsible walls.

3. The container of claim 1, wherein said cap and piercing member are so configured as to be useable as a transfer adaptor for fluid communication between said container and a syringe, said piercing member having a first end and a second end, said first end serving to pierce said seal, said second end comprising a female receptor to receive a male exit nozzle of a syringe, said second end further comprising a male receptor for a female opening of a reservoir whose contents are intended for transfer into said container.

4. The container of claim 1, wherein said piercing member defines an enclosed duct so configured that, after piercing said seal and engaging said collar, said piercing member provides a passage for liquid from said reservoir.

5. The container of claim 1, wherein said piercing member is a male cone having a duct which has its opening in the proximity of the tip of said cone, but not in said tip of said cone.

6. The container of claim 1, wherein said cap and said neck are provided with screw threads, said screw threads being so configured that, when said cap is screwed onto said neck, the first half-turn of said cap onto said screw thread of said neck is sufficient to cause rupture of said seal by said screw member, with further action tightly locating said piercing member in said collar.

7. A blow-fill-seal container for dispensing sterile liquids, said container comprising a reservoir, a dispensing neck and a collar, said neck having a hermetic seal thereover, said collar defining an opening and being located within said neck in juxtaposition to said seal, wherein said neck, said seal, said reservoir and said collar are integrally formed each with the other, a cap for said container being locatable over said neck and comprising a piercing member, wherein said cap and said piercing member are so configured that, when said cap is forcibly fitted over said neck, said piercing member passes into said neck thereby piercing said seal; and, thereafter, locates in said opening thereby to sealingly engage with said collar.

8. The container of claim 7, wherein said neck is reinforced.

9. The container of claim 8, wherein said neck is reinforced by thickened walls.

10. The container of claim 8, wherein said neck is reinforced by supporting webs extending from said reservoir of said container along said neck.

11. The container of claim 7, wherein said reservoir is collapsible to prevent suck-back.

12. The container of claim 7, constructed for multiple usage.

13. The container of claim 7, wherein said neck is equipped with a screw-thread mateable with a screw thread located on said cap.

14. The container of claim 7, wherein said fit of said cap on said neck is a bayonet fitting.

15. The container of claim 7, wherein, on one of said cap and said container, there is further provided a snap-fit collar so configured that, when said cap is fitted over said neck, said cap is locked into place.

16. The container of claim 7, wherein said piercing member defines an enclosed duct so configured that, after piercing said seal and engaging said collar, said piercing member provides a passage for liquid from said reservoir.

17. The container of claim 7, wherein said piercing member is a male cone having a duct which has its opening in the proximity of the tip of said cone, but not in said tip of said cone.

18. The container of claim 17, wherein said male cone is a luer.

19. The container of claim 7, wherein said cap and said neck are provided with screw threads, said screw threads being so configured that, when said cap is screwed onto said neck, the first half-turn of said cap onto said screw thread of said neck is sufficient to cause rupture of said seal by said screw member, with further action tightly locating said piercing member in said collar.

20. The container of claim 7, wherein said cap and piercing member are so configured as to be useable as a transfer adaptor for fluid communication between said container and a syringe, said piercing member defining an enclosed duct so configured that, after piercing said seal and engaging said collar, said piercing member provides a passage for liquid from said reservoir, said piercing member having a proximal end and a distal end defining openings for said duct, said distal end serving to pierce said seal, said proximal end being so configured as to provide both a male receptor and a female receptor, said female receptor being located within said male receptor and being so configured as to be able to receive a male exit nozzle of a syringe, and said male receptor being so configured as to be able to receive a female opening of a reservoir whose contents are intended for transfer into said container.

* * * * *